US006064188A

United States Patent [19]

Takashima et al.

[11] Patent Number: 6,064,188

[45] Date of Patent: May 16, 2000

[54] INTERNAL STEP-DOWN CONVERTER

[75] Inventors: Satoshi Takashima, Hyogo; Makoto Kojima, Osaka, both of Japan

[73] Assignee: Matsushita Electric Industrial Co., Ltd., Osaka, Japan

[21] Appl. No.: 09/398,427

[22] Filed: Sep. 17, 1999

[30] Foreign Application Priority Data

Sep. 21, 1998 [JP] Japan ..... 10-266276

[51] Int. Cl.[7] ..... G05F 3/16; G05F 3/20

[52] U.S. Cl. ..... 323/316; 323/313

[58] Field of Search ..... 323/313, 315, 323/316

[56] References Cited

U.S. PATENT DOCUMENTS

| | | | |
|---|---|---|---|
| 5,352,935 | 10/1994 | Yamamura et al. | 323/313 |
| 5,373,226 | 12/1994 | Kimura | 323/313 |
| 5,408,172 | 4/1995 | Tanimoto et al. | 323/273 |
| 5,757,226 | 5/1998 | Yamada et al. | 323/316 |
| 5,990,671 | 11/1999 | Nagata | 323/315 |

FOREIGN PATENT DOCUMENTS

| | | | |
|---|---|---|---|
| 06162772 | 10/1994 | Japan | G11C 11/407 |

*Primary Examiner*—Adolf Deneke Berhane
*Assistant Examiner*—Bao Q. Vu
*Attorney, Agent, or Firm*—McDermott, Will & Emery

[57] ABSTRACT

An internal step-down converter includes a potential difference detector and a cross-coupled amplifier. The potential difference detector detects and amplifies a potential difference between a reference voltage VREF and an internally-stepped-down supply voltage VINT. The cross-coupled amplifier receives the amplified output VDRV2 of the potential difference detector and the output VDRV of a current-mirror differential amplifier, which is applied as a control voltage to a driver implemented as a p-channel MOSFET. The cross-coupled amplifier regulates the amplitude of the control voltage VDRV substantially at the potential difference |VDD−VSS| between the external supply voltages. As a result, the load-current-handling capability of the driver can be considerably increased. While the load current ILOAD is relatively small, a control signal generator deactivates the potential difference detector and the cross-coupled amplifier to prevent the current from being consumed in vain. Accordingly, an internal step-down converter with enhanced load-current-handling capability is provided without increasing the layout area or the current consumed.

9 Claims, 8 Drawing Sheets

INTERNAL STEP-DOWN CONVERTER

BACKGROUND OF THE INVENTION

The present invention relates to an improved internal step-down converter, which may be built in a semiconductor integrated circuit for stepping an external supply voltage down to a predetermined voltage.

A conventional internal step-down converter includes a current-mirror differential amplifier 1 and a driver 2 as shown in FIG. 8. The differential amplifier 1 generates a differentially amplified output voltage VDRV by amplifying a potential difference between a reference voltage VREF and an internally-stepped-down supply voltage VINT. The driver 2 may be implemented as a p-channel MOSFET, which receives the voltage VDRV at its gate and supplies a current in such an amount as to regulate the voltage VINT at a predetermined value.

In the internal step-down converter with such a configuration, as a load current ILOAD increases, the internally-stepped-down supply voltage VINT decreases. On and after the internally-stepped-down supply voltage VINT has decreased to be lower than the reference voltage VREF, the differentially amplified output voltage VDRV of the differential amplifier 1 becomes low. In such a situation, the current-handling capability of the driver 2 is enhanced to raise the internally-stepped-down supply voltage VINT. On the other hand, once the internally-stepped-down supply voltage VINT exceeds the reference voltage VREF, the differentially amplified output voltage VDRV becomes high. As a result, the current-handling capability of the driver 2 declines or the driver 2 stops supplying the current. In this manner, the internally-stepped-down supply voltage VINT is regulated at the reference voltage VREF.

In the conventional internal step-down converter, however, the output voltage of the differential amplifier 1 has an amplitude smaller than a potential difference |VDD−VSS| between external supply voltages VDD and VSS. Thus, the current-handling capability of the driver 2 cannot be made full use of. Accordingly, to increase the load-current-handling capability of the driver 2, the p-channel MOSFET, which constitutes the driver 2, should have its channel width increased. Also, to maintain the transient response speed of the internal step-down converter, a constant current IS, always flowing through the differential amplifier 1, should be increased. That is to say, to increase the load-current-handling capability of the internal step-down converter, the layout area and current consumed should be increased, thus interfering with the downsizing of, and reduction in power consumed by, a semiconductor integrated circuit.

Furthermore, if the external supply voltage VDD is set low, then the output voltage VDRV of the differential amplifier 1 has its amplitude decreased. As a result, the current-handling capability of the driver 2 declines drastically. Accordingly, it is very difficult to supply a constant internally-stepped-down supply voltage VINT to the semiconductor integrated circuit.

SUMMARY OF THE INVENTION

An object of the present invention is enhancing the load-current-handling capability of an internal step-down converter without increasing either the channel width of a p-channel MOSFET implemented as a driver or a constant current flowing through a current-mirror differential amplifier.

To achieve this object, the amplitude of a control voltage applied to the driver is regulated according to the present invention substantially at a potential difference |VDD−VSS| between the external supply voltages.

Specifically, an internal step-down converter according to the present invention includes: a differential amplifier for amplifying a potential difference between an internally-stepped-down supply voltage at a node and a reference voltage; internal power supply driving means, which is controlled by an output voltage of the differential amplifier, for supplying a current to the node; means for detecting the potential difference between the internally-stepped-down supply voltage at the node and the reference voltage; and a cross-coupled amplifier for receiving an output voltage of the detecting means and the output voltage of the differential amplifier.

In one embodiment of the present invention, the differential amplifier may be implemented as a current-mirror differential amplifier.

In another embodiment of the present invention, the converter may further include control signal generating means for selectively activating/deactivating the detecting means and the cross-coupled amplifier depending on the magnitude of a load current flowing from the node.

In an alternate embodiment, the converter may further include control signal generating means for selectively activating/deactivating the detecting means and the cross-coupled amplifier depending on a value of an external supply voltage.

In another alternate embodiment, the converter may further include control signal generating means for selectively activating/deactivating the detecting means and the cross-coupled amplifier depending on the potential difference between the reference voltage and the internally-stepped-down supply voltage at the node.

In still another embodiment, the output voltage of the differential amplifier, which is applied as a control signal to the driving means, may rise and fall along the same locus with increase and decrease in the internally-stepped-down supply voltage at the node, and may form no hysteresis loop.

In this particular embodiment, the detecting means may be implemented as a differential amplifier, which performs a feedback control of the type opposite to that performed by the other differential amplifier, and may include a plurality of transistors. Each said transistor is of the same size as an associated transistor included in the other differential amplifier. And the cross-coupled amplifier may include a pair of symmetrically disposed transistors of the same size, which receive the output voltages of the detecting means and the differential amplifier, respectively.

In still another embodiment, the output voltage of the differential amplifier, which is applied as a control signal to the driving means, may rise and fall along mutually different loci with increase and decrease in the internally-stepped-down supply voltage at the node, and may form a hysteresis loop.

In this particular embodiment, the size of a transistor included in the differential amplifier may be different from that of an associated transistor included in the detecting means, and/or the sizes of a pair of symmetrically disposed transistors included in the cross-coupled amplifier may be different from each other.

In the internal step-down converter of the present invention, the potential difference detecting means detects a potential difference between the reference voltage and the internally-stepped-down supply voltage (i.e., a target stepped-down voltage). And this potential difference and the output of the differential amplifier are both supplied to the cross-coupled amplifier. Accordingly, the cross-coupled amplifier can adaptively change the output of the differential amplifier, i.e., a control voltage applied to the internal power supply driving means, depending on the potential difference. And the control voltage can have its amplitude substantially regulated at the potential difference |VDD−VSS| between external supply voltages. Thus, the current-handling capability of the internal step-down converter increases.

In particular, the potential difference detecting means and the cross-coupled amplifier, which are additionally provided according to the present invention, may be selectively activated by the control signal generating means only when higher current-handling capability is needed. That is to say, if there is no need to increase the current-handling capability from the normal one, these newly provided circuits are not activated unnecessarily. Thus, the current consumed does not increase in vain even in such a situation.

DESCRIPTION OF THE PREFERRED EMBODIMENTS

Hereinafter, preferred embodiments of the present invention will be described with reference to the accompanying drawings.

Figure 1:
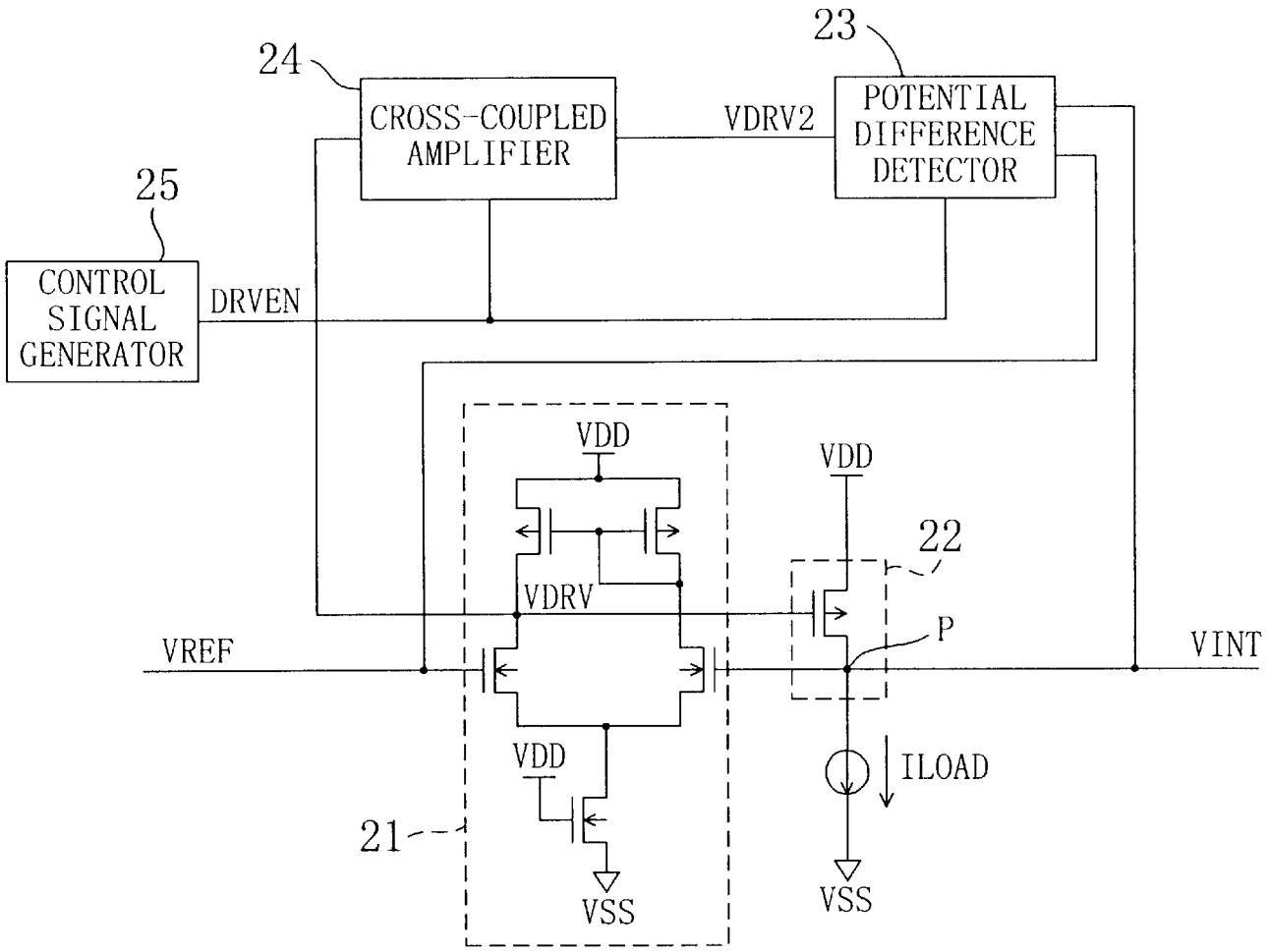
FIG. 1 illustrates an internal step-down converter according to an exemplary embodiment of the present invention.

FIG. 1 illustrates a circuit diagram of an internal step-down converter according to an exemplary embodiment of the present invention. The internal step-down converter may be built in a semiconductor integrated circuit such as a DRAM.

As shown in FIG. 1, the internal step-down converter includes a negative feedback current-mirror differential amplifier 21 and a driver 22. The driver 22 is an exemplary internal power supply driving means as defined in the appended claims and may be implemented as a p-channel MOSFET. Specifically, the differential amplifier 21 receives a reference voltage VREF and an internally-stepped-down supply voltage VINT at a node P, and amplifies and outputs a potential difference between these voltages VREF and VINT. The driver 22 controls the current supplied at the node P in accordance with the amplified output VDRV of the differential amplifier 21. These circuits 21 and 22 may have the same configurations as the conventional ones. The reference voltage VREF is generated inside the semiconductor integrated circuit as a constant voltage that does not change even if a supply voltage has varied.

The internal step-down converter according to the present invention further includes a potential difference detector 23, a cross-coupled amplifier 24 and a control signal generator 25. The potential difference detector 23 and the control signal generator 25 are exemplary potential difference detecting means and control signal generating means, respectively, as defined in the appended claims. The potential difference detector 23 receives the reference voltage VREF and the internally-stepped-down supply voltage VINT, detects and further amplifies a potential difference between these voltages VREF and VINT and then outputs the amplified voltage VDRV2. The cross-coupled amplifier 24 receives the respective amplified outputs VDRV and VDRV2 of the differential amplifier 21 and the potential difference detector 23.

The control signal generator 25 generates a control signal DRVEN for selectively activating/deactivating the potential difference detector 23 and the cross-coupled amplifier 24. The potential difference detector 23 and the cross-coupled amplifier 24 are both deactivated responsive to the control signal DRVEN while the synchronous DRAM is operating in standby or normal mode, not in burst or bank interleave mode. That is to say, these circuits 23 and 24 are deactivated while the load current ILOAD supplied by the driver 22 is relatively small. In the burst or bank interleave mode, i.e., while the load current supplied by the driver 22 is relatively large, the control signal generator 25 generates such a control signal DRVEN as activating these circuits 23 and 24.

Figure 2:
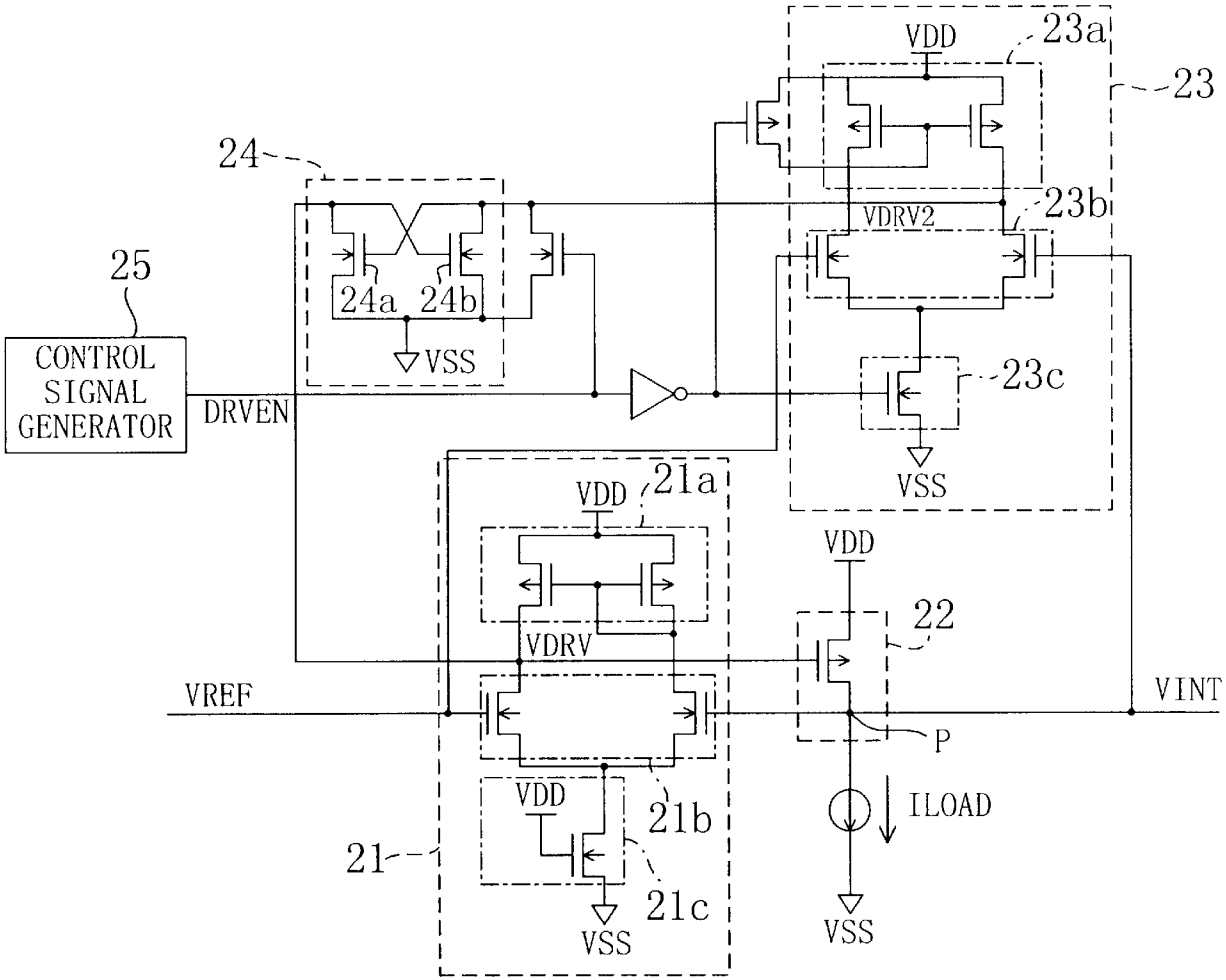
FIG. 2 illustrates a specific configuration of the internal step-down converter.

Specifically, the potential difference detector 23 may be implemented as a current-mirror differential amplifier 23, which receives the reference voltage VREF and the internally-stepped-down supply voltage VINT, amplifies the potential difference between these voltages and outputs the amplified voltage VDRV2 as shown in FIG. 2. This differential amplifier 23 performs a feedback control of the opposite type to that of the negative feedback current-mirror differential amplifier 21. That is to say, the differential amplifier 23 performs a positive feedback control.

As shown in FIG. 2, the cross-coupled amplifier 24 may include a pair of n-channel MOSFETs 24*a* and 24*b* receiving the amplified outputs VDRV and VDRV2 of the negative and positive feedback current-mirror differential amplifiers 21 and 23, respectively.

The n-channel MOSFETs 24*a* and 24*b*, which are disposed symmetrically to form the cross-coupled amplifier 24, may be of the same size. Also, the negative and positive current-mirror differential amplifiers 21 and 23 may be different from each other only in the type of the feedback control performed, and may have exactly the same configuration. That is to say, each pair of associated sections 21*a* and 23*a*, 21*b* and 23*b* or 21*c* and 23*c* includes at least one transistor of the same size.

Figure 4:
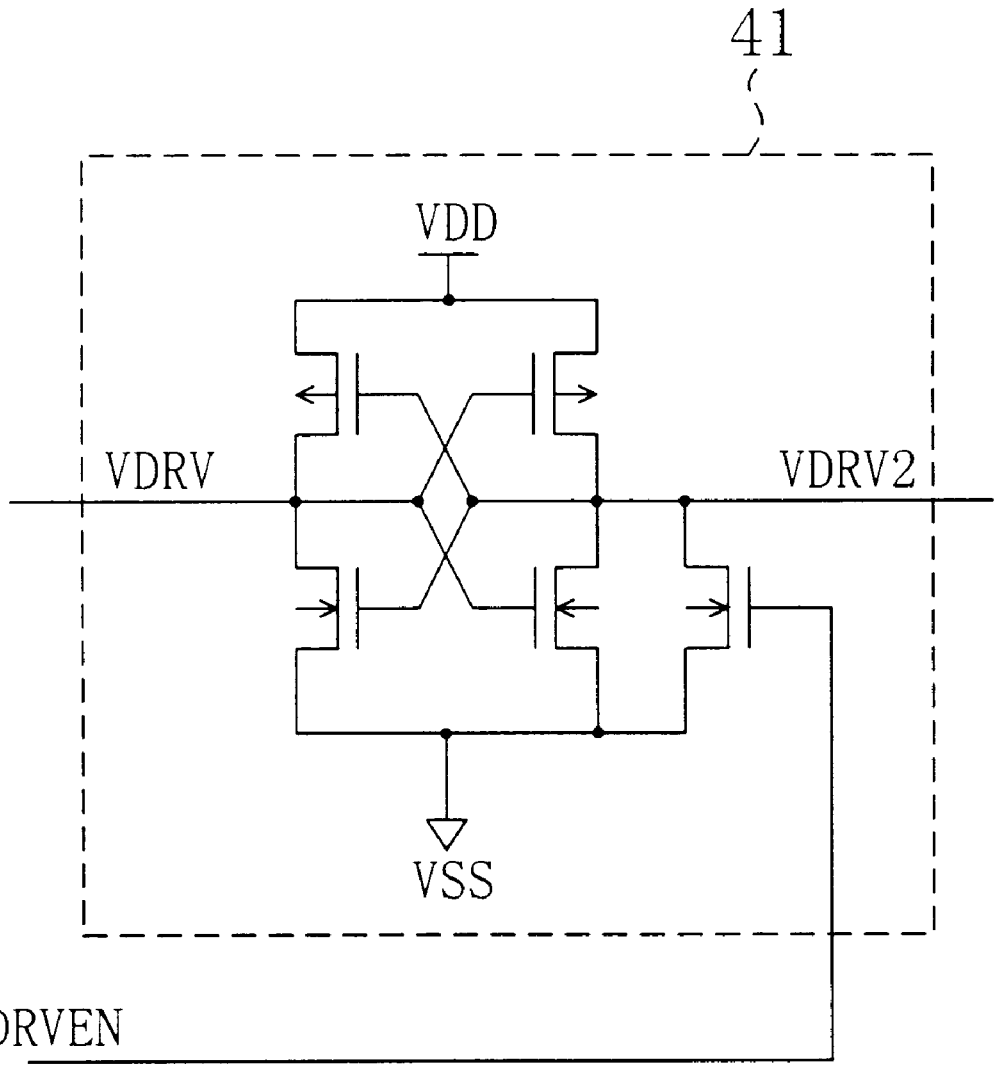
FIG. 4 illustrates an alternate cross-coupled amplifier for the internal step-down converter.

In the foregoing embodiment, the potential difference detector 23 is implemented as the positive feedback current-mirror differential amplifier 23. It should be noted, however, that the present invention is in no way limited to such a specific embodiment. For example, the potential difference detector 23 may include a negative feedback current-mirror differential amplifier 31 and a CMOS inverter ratio circuit 32 for inverting the output of the differential amplifier 31 and then outputting the inverted output VDRV2. Also, the cross-coupled amplifier 24 consists of n-channel MOSFETs only in the foregoing embodiment. Alternatively, a cross-coupled amplifier 41 including n- and p-channel MOSFETs may also be used as shown in FIG. 4.

Figure 3:
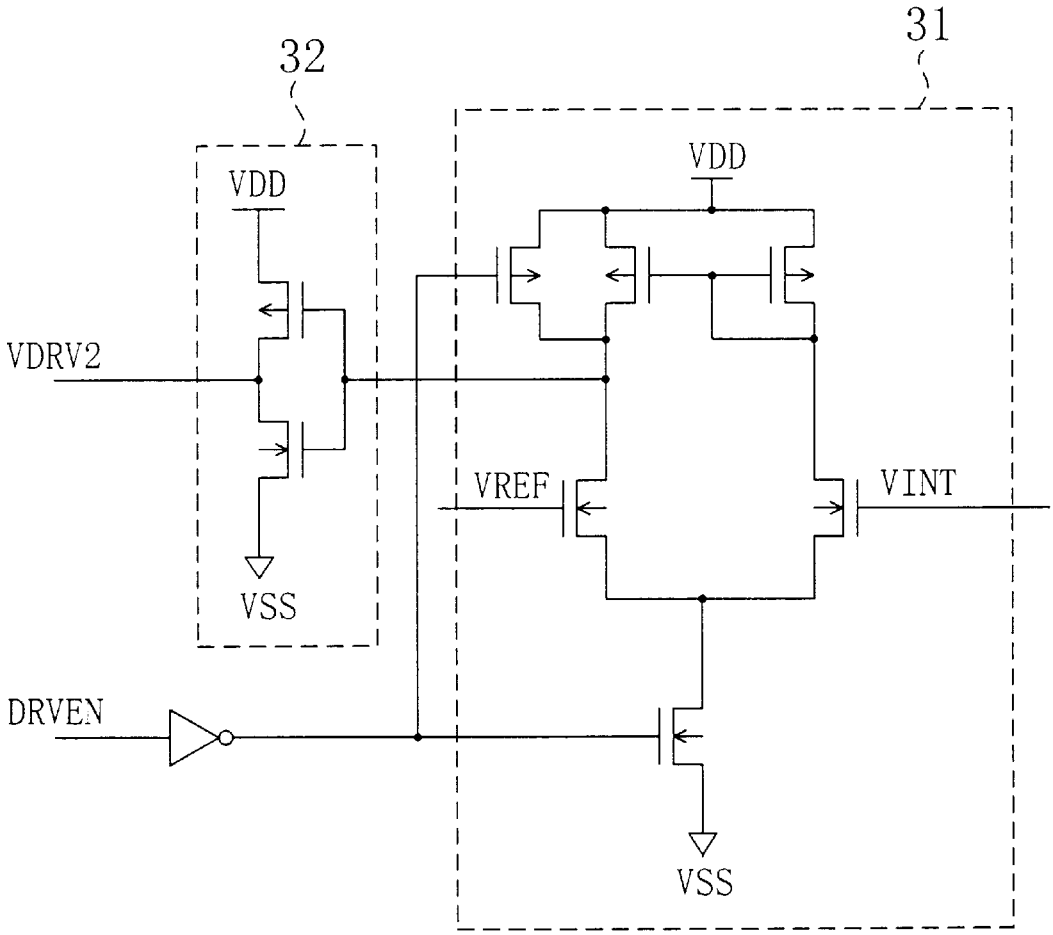
FIG. 3 illustrates an alternate potential difference detector for the internal step-down converter.

Hereinafter, the operation of the internal step-down converter according to the present invention will be described with reference to FIG. 2. It should be noted that the potential difference detector and the cross-coupled amplifier 41 shown in FIGS. 3 and 4 operate basically in the same way as the counterparts 23 and 24, respectively, shown in FIG. 2, and the description thereof will be omitted herein.

As the load current ILOAD increases, the internally-stepped-down supply voltage VINT decreases. On and after the internally-stepped-down supply voltage VINT has decreased to be lower than the reference voltage VREF, the output voltage VDRV of the negative feedback current-mirror differential amplifier 21 becomes low. In such a situation, the current-handling capability of the driver 22 is enhanced to raise the internally-stepped-down supply voltage VINT. These operations are the same as those described for the conventional internal step-down converter. However, the operation of the internal step-down converter according to the present invention is essentially different from that of the conventional internal step-down converter in the following respect. Specifically, in the conventional internal step-down converter, even if the internally-stepped-down supply voltage VINT remains lower than the reference voltage VREF, the output voltage VDRV of the negative feedback current-mirror differential amplifier 1 does not decrease to the ground potential VSS. In contrast, in the internal step-down converter according to the present invention, the lowest possible potential of the output voltage VDRV of the negative feedback current-mirror differential amplifier 21 can be substantially equalized with the ground potential VSS by providing the potential difference detector 23 and the cross-coupled amplifier 24. This point will be described in further detail below.

On and after the internally-stepped-down supply voltage VINT has decreased to be lower than the reference voltage VREF, the output voltage VDRV of the negative feedback current-mirror differential amplifier 21 becomes low, whereas the output voltage VDRV2 of the positive feedback current-mirror differential amplifier 23 becomes high. The cross-coupled amplifier 24, which receives these amplified outputs VDRV and VDRV2, can further decrease the output voltage VDRV of the negative feedback current-mirror differential amplifier 21. Thus, by additionally providing the positive feedback current-mirror differential amplifier 23 and cross-coupled amplifier 24, the output voltage VDRV of the negative feedback current-mirror differential amplifier 21 can be even lower than that attained by the differential amplifier 21 alone, and substantially equalized with the ground potential VSS. Accordingly, compared to the conventional internal step-down converter, the load-current-handling capability can be considerably enhanced although the driver 22 is implemented as a p-channel MOSFET of the same size as the conventional one.

On the other hand, once the internally-stepped-down supply voltage VINT has exceeded the reference voltage VREF, the output voltage VDRV of the negative feedback current-mirror differential amplifier 21 becomes high. In this case, the cross-coupled amplifier 24 further increases the differentially amplified output voltage VDRV of the negative feedback current-mirror differential amplifier 21 and further decreases the output voltage VDRV2 of the positive feedback current-mirror differential amplifier 23. As a result, the current supplied by the driver 22 decreases or becomes zero.

In this embodiment, the n-channel MOSFETs 24*a* and 24*b* for the cross-coupled amplifier 24 are of the same size and each transistor in the negative feedback current-mirror differential amplifier 21 is also of the same size as the counterpart in the positive feedback current-mirror differential amplifier 23. Accordingly, the amplified output VDRV of the negative feedback current-mirror differential amplifier 21 rises and falls along the same locus with the increase and decrease in the internally-stepped-down supply voltage VINT and forms no hysteresis loop as shown in FIG. 5(*a*).

In this embodiment, the amplified output VDRV of the negative feedback current-mirror differential amplifier 21 is supposed to form no hysteresis loop. Alternatively, the amplified output VDRV may intentionally form a hysteresis loop as shown in FIG. 5(*b*). This can be done by changing the size of at least one of the n-channel MOSFETs 24*a* and 24*b* included in the cross-coupled amplifier 24 and/or the sizes of respective transistors included in the sections 21*a* through 21*c* and 23*a* through 23*c* of the current-mirror differential amplifiers 21 and 23. In this embodiment, the n-channel MOSFETs 24*a* and 24*b* of the same size are used for the cross-coupled amplifier 24. In addition, the ratio of the channel width to the channel length of each transistor for the positive feedback current-mirror differential amplifier 23 is reduced to about two-thirds of that of each transistor for the negative feedback current-mirror differential amplifier 21. In such a case, the amplified output VDRV of the negative feedback current-mirror differential amplifier 21 rises and falls along mutually different loci with the increase and decrease in the internally-stepped-down supply voltage VINT and forms a hysteresis loop as shown in FIG. 5(*b*).

By forming the hysteresis loop, the following effects are attained. On and after the internally-stepped-down supply voltage VINT becomes lower than the reference voltage VREF, the driver 22 turns ON. On the other hand, once the internally-stepped-down supply voltage VINT near the negative feedback current-mirror differential amplifier 21 exceeds the reference voltage VREF, the driver 22 turns OFF. But a problem might happen at a point distant from the driver 22 (hereinafter, referred to as a "point D") for some reason such as voltage drop resulting from interconnection resistance. Specifically, if the distance between the point D and the driver 22 is longer than the distance between the negative feedback current-mirror differential amplifier 21 and the driver 22, then the internally-stepped-down supply voltage VINT at the point D might be lower than the reference voltage VREF. This is a serious problem because the internally-stepped-down supply voltage VINT at the point D might be lower than the lowest permissible value thereof. However, if the hysteresis loop is formed as shown in FIG. 5(*b*), then the driver 22 will continue to operate by the time the internally-stepped-down supply voltage VINT near the driver 22 becomes higher than the reference voltage VREF by a voltage corresponding to the width of the hysteresis loop. Accordingly, current is continuously supplied to the point D during this interval to restore the internally-stepped-down supply voltage VINT at the point D to the reference voltage VREF. Thus, if the hysteresis loop is formed, then a constant internally-stepped-down supply voltage VINT can be supplied to the overall semiconductor integrated circuit.

Figure 5A:
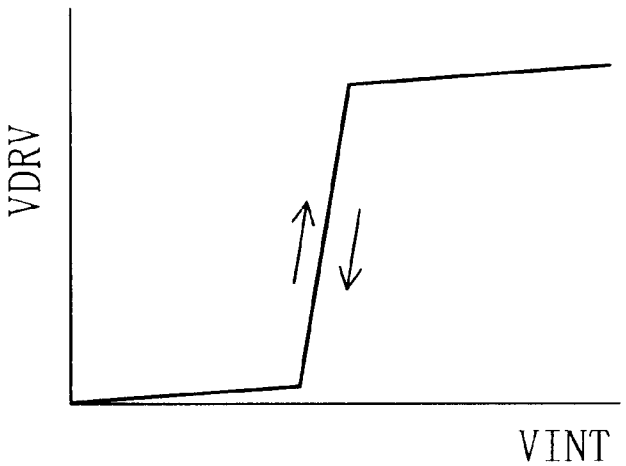
FIGS. 5(*a*) and 5(*b*) illustrate output waveforms of the negative feedback current-mirror differential amplifier for the internal step-down converter without and with a hysteresis loop, respectively.
Figure 5B:
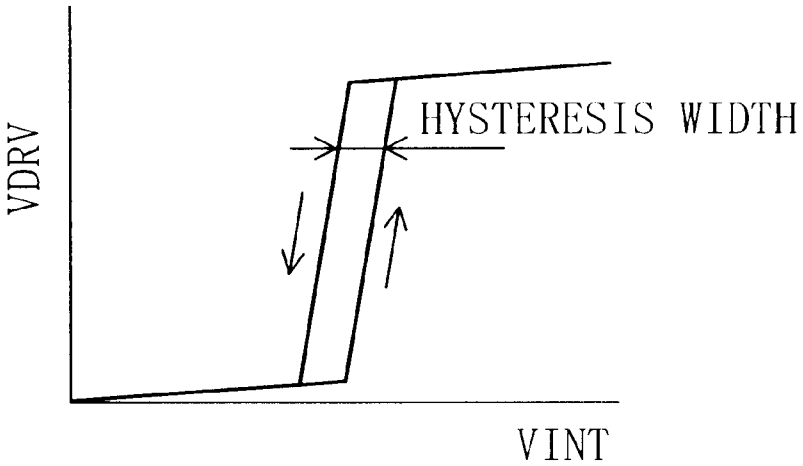

On the other hand, if no hysteresis loop is formed as in FIG. 5(*a*), then the internally-stepped-down supply voltage VINT near the node P can always kept at the reference voltage VREF. Thus, if the internal step-down converter according to this embodiment is disposed inside the memory array of a DRAM, for example, then a constant internally-stepped-down supply voltage VINT can always be supplied to the memory array.

Also, according to the present invention, the control signal generator 25 selectively activates or deactivates the positive feedback current-mirror differential amplifier 23 and the cross-coupled amplifier 24. As long as the synchronous DRAM is operating in the standby or normal mode, not in the burst or bank interleave mode, i.e., while the current-handling capability may be low, these circuits 23 and 24 are deactivated. And the load current ILOAD is supplied only by the negative feedback current-mirror differential amplifier 21 and the driver 22, i.e., by using only the conventional internal step-down converter. On the other hand, while the synchronous DRAM is operating in the burst or bank interleave mode, i.e., when high current-handling capability is required, the positive feedback current-mirror differential amplifier 23 and the cross-coupled amplifier 24 are both activated. And the lowest possible potential of the amplified output voltage VDRV of the negative feedback current-mirror differential amplifier 21 is substantially equalized with the external supply voltage VSS. As a result, the driver 22 can have its current-handling capability enhanced to cope with the increase in load current ILOAD. Thus, the current consumed by the internal step-down converter can be further reduced.

(First Modified Example of Control Signal Generator)

Figure 6:
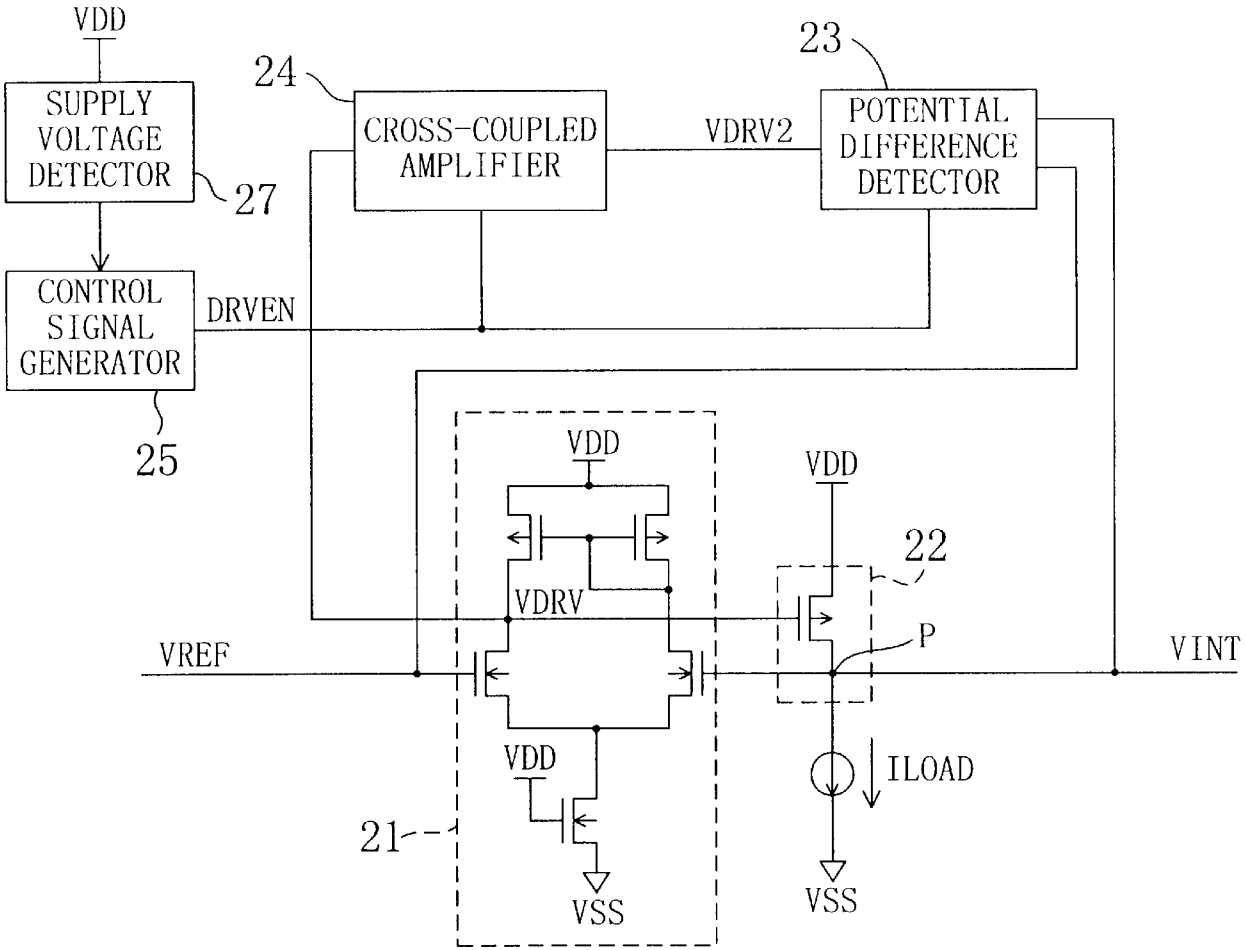
FIG. 6 illustrates a first modified example of a control signal generator for the internal step-down converter.

FIG. 6 illustrates a first modified example of the control signal generator. In this modified example, a supply voltage detector 27 is further provided for detecting the potential of the external supply voltage VDD. When the detector 27 finds the potential of the external supply voltage VDD lower than a predetermined potential, the detector 27 supplies a detection signal to the control signal generator 25. Responsive to the detection signal, the control signal generator 25 generates such a control signal DRVEN as activating the potential difference detector 23 and the cross-coupled amplifier 24. On the other hand, while the control signal generator 25 receives no detection signal, the generator 25 generates such a control signal as deactivating the potential difference detector 23 and the cross-coupled amplifier 24.

If the external supply voltage VDD becomes low during the initial operation, i.e., while only the negative feedback current-mirror differential amplifier 21 is operating to control the driver 22 with the amplified output VDRV thereof, the current-handling capability of the driver 22 is going to decrease. In such a situation, however, the control signal generator 25 activates the potential difference detector 23 and the cross-coupled amplifier 24, thereby reducing the lowest possible potential of the amplified output voltage VDRV of the negative feedback current-mirror differential amplifier 21 substantially to the external supply voltage VSS. As a result, it is possible to prevent the current-handling capability of the driver 22 from declining.

(Second Modified Example of Control Signal Generator)

Figure 7:
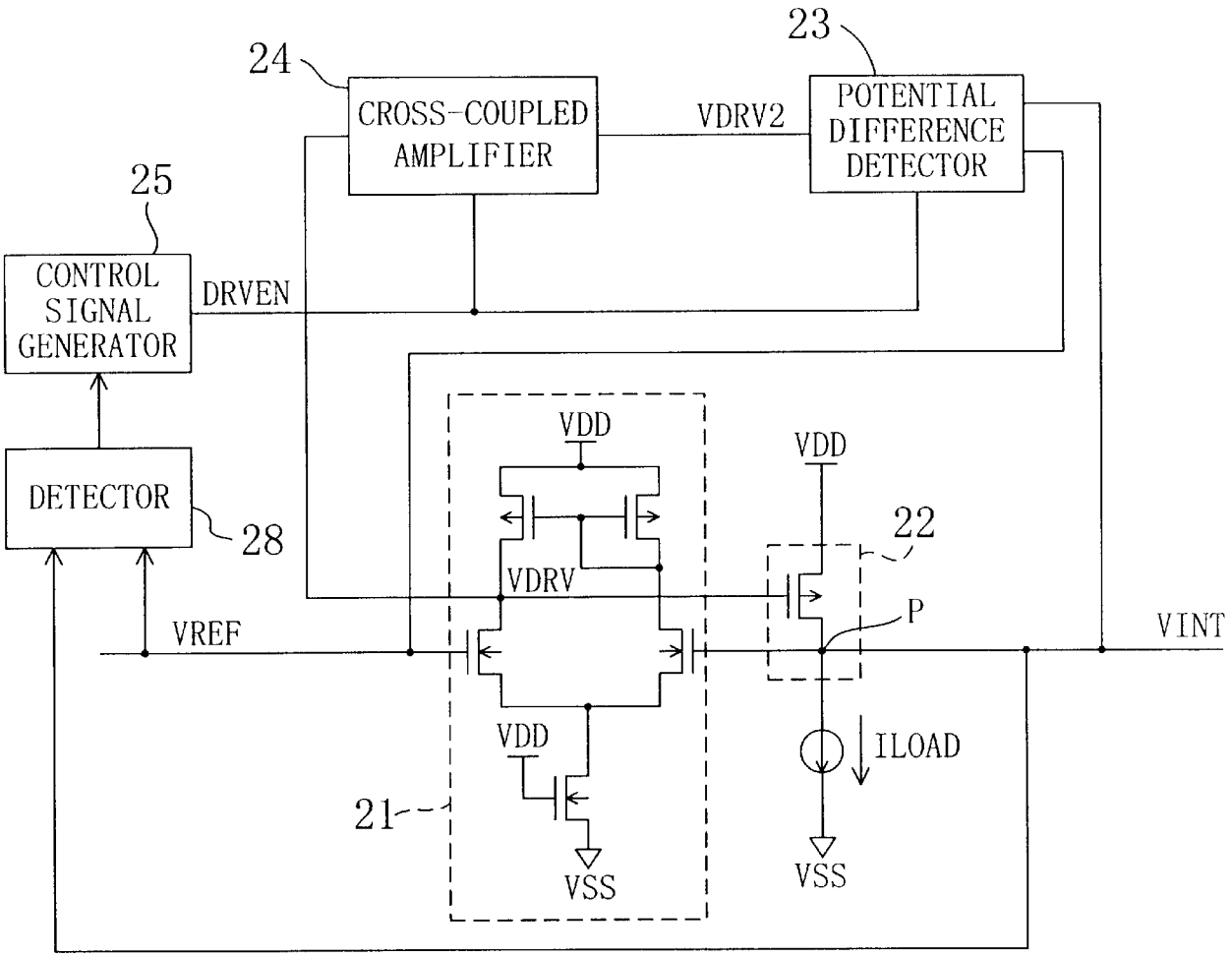
FIG. 7 illustrates a second modified example of the control signal generator.
Figure 8:
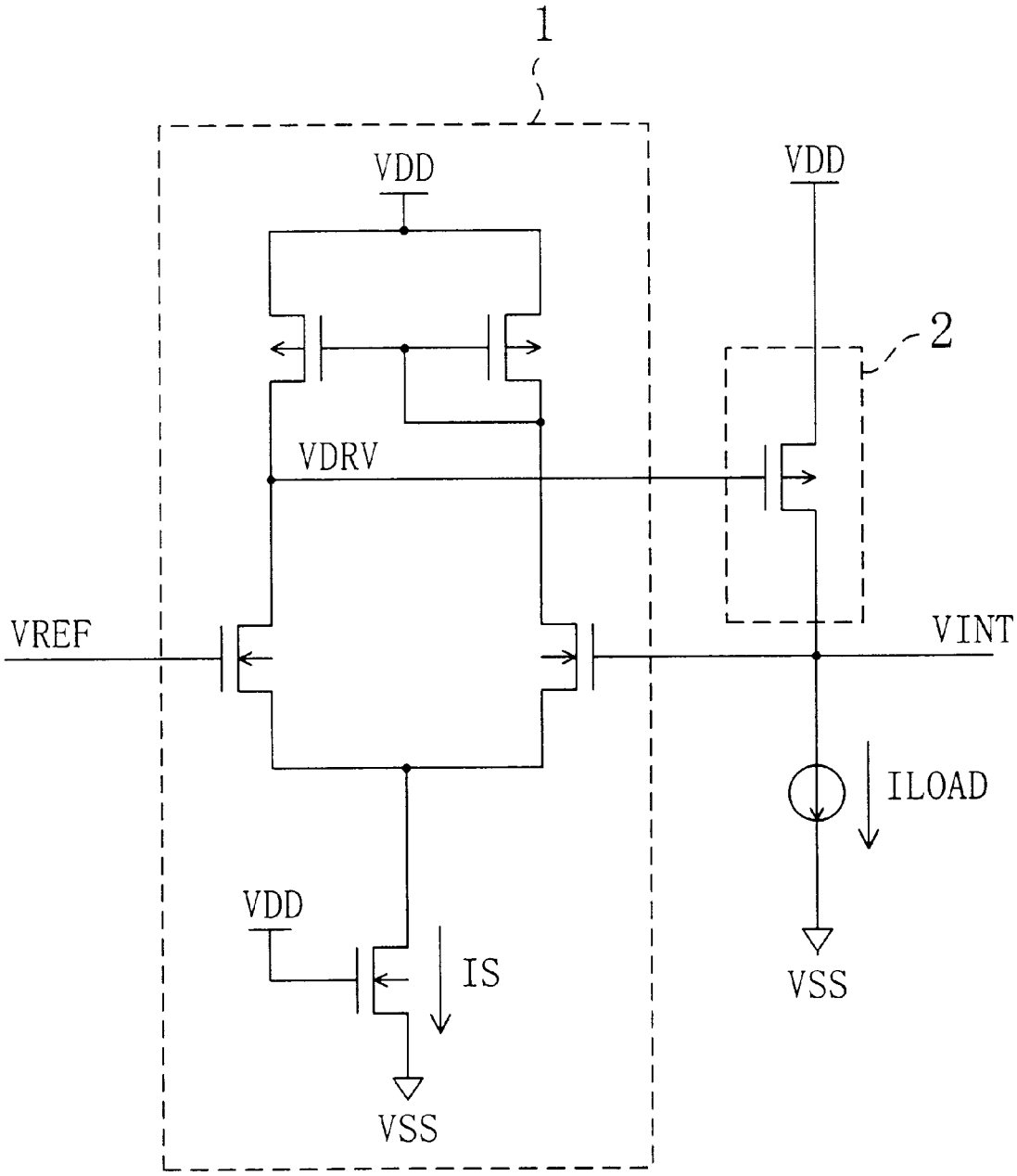
Fig. 8 Prior Art
FIG. 8 illustrates a conventional internal step-down converter.

FIG. 7 illustrates a second modified example of the control signal generator. In this modified example, a detector 28 receiving the internally-stepped-down supply voltage VINT and the reference voltage VREF is further provided. When the detector 28 finds the internally-stepped-down supply voltage VINT equal to or less than (VREF−ΔVREF), the detector 28 outputs a detection signal to the control signal generator 25. In this example, Δ VREF is supposed to be a positive preset voltage. Responsive to the detection signal, the control signal generator 25 generates such a control signal DRVEN as activating the potential difference detector 23 and the cross-coupled amplifier 24 as in the first modified example.

Suppose the internally-stepped-down supply voltage VINT has become lower than the reference voltage VREF due to the increase in load current ILOAD from the node P. Then, the control signal generator 25 also activates the potential difference detector 23 and cross-coupled amplifier 24 in this modified example, thereby enhancing the current-handling capability of the driver 22 to cope with the increase in load current ILOAD.

As described above, the internal step-down converter according to the present invention substantially equalizes the amplitude of the control voltage applied to the internal power supply driver with the potential difference |VDD−VSS| between the external supply voltages by using the cross-coupled amplifier. Thus, the current-handling capability can be enhanced without increasing the channel width of the p-channel MOSFET as the internal power supply driver or increasing the constant current flowing through the differential amplifier.

In particular, the internal step-down converter according to the present invention selectively activates the additionally provided potential difference detector and cross-coupled amplifier only when higher current-handling capability is required. Accordingly, the current consumed can be further reduced.

What is claimed is:

1. An internal step-down converter comprising:

a differential amplifier for amplifying a potential difference between an internally-stepped-down supply voltage at a node and a reference voltage;

internal power supply driving means, which is controlled by an output voltage of the differential amplifier, for supplying a current to the node;

means for detecting the potential difference between the internally-stepped-down supply voltage at the node and the reference voltage; and a cross-coupled amplifier for receiving an output of the detecting means and the output voltage of the differential amplifier.

2. The converter of claim 1, wherein the differential amplifier is implemented as a current-mirror differential amplifier.

3. The converter of claim 1 or 2, further comprising control signal generating means for selectively activating/deactivating the detecting means and the cross-coupled amplifier depending on the magnitude of a load current flowing from the node.

4. The converter of claim 1 or 2, further comprising control signal generating means for selectively activating/deactivating the detecting means and the cross-coupled amplifier depending on a value of an external supply voltage.

5. The converter of claim 1 or 2, further comprising control signal generating means for selectively activating/deactivating the detecting means and the cross-coupled amplifier depending on the potential difference between the reference voltage and the internally-stepped-down supply voltage at the node.

6. The converter of claim 1 or 2, wherein the output voltage of the differential amplifier, which is applied as a control signal to the driving means, rises and falls along the same locus with increase and decrease in the internally-stepped-down supply voltage at the node, and forms no hysteresis loop.

7. The converter of claim 6, wherein the detecting means is implemented as a differential amplifier, which performs a feedback control of the type opposite to that performed by the other differential amplifier, and includes a plurality of transistors, each said transistor being of the same size as an associated transistor included in the other differential amplifier, and wherein the cross-coupled amplifier includes a pair of symmetrically disposed transistors of the same size, which receive the output voltages of the detecting means and the differential amplifier, respectively.

8. The converter of claim 1 or 2, wherein the output voltage of the differential amplifier, which is applied as a control signal to the driving means, rises and falls along mutually different loci with increase and decrease in the internally-stepped-down supply voltage at the node, and forms a hysteresis loop.

9. The converter of claim 8, wherein the size of a transistor included in the differential amplifier is different from that of an associated transistor included in the detecting means, and/or the sizes of a pair of symmetrically disposed transistors included in the cross-coupled amplifier are different from each other.

* * * * *